United States Patent [19]

Larson

[11] 4,094,415

[45] June 13, 1978

[54] DISPLAY RACK DEVICE

[75] Inventor: Charles O. Larson, Sterling, Ill.

[73] Assignee: Chas. O. Larson Co., Sterling, Ill.

[21] Appl. No.: 529,154

[22] Filed: Dec. 3, 1974

Related U.S. Application Data

[63] Continuation of Ser. No. 372,411, Jun. 21, 1973, abandoned.

[51] Int. Cl.[2] ..... A47F 7/00; A47B 96/06

[52] U.S. Cl. ..... 211/57.1; 211/87; 211/94; 248/220.3

[58] Field of Search ..... 248/223, DIG. 3, 220.3; 211/54, 57, 59, 94, 87

[56] References Cited

U.S. PATENT DOCUMENTS

| | | | |
|---|---|---|---|
| 1,800,387 | 4/1931 | Greist | 211/94 X |
| 2,754,974 | 7/1956 | Larson | 248/DIG. 3 X |
| 2,884,221 | 4/1959 | Messier | 248/DIG. 3 X |
| 2,974,804 | 3/1961 | Maro | 248/DIG. 3 X |
| 3,069,122 | 12/1962 | Babajoff | 248/DIG. 3 X |
| 3,244,390 | 4/1966 | Kerr | 248/DIG. 3 X |
| 3,279,620 | 10/1966 | Nesbitt | 248/223 X |
| 3,424,421 | 1/1969 | Kalbow et al. | 248/DIG. 3 X |
| 3,477,677 | 11/1969 | Hindley | 248/DIG. 3 X |
| 3,669,034 | 6/1972 | Marschak | 248/DIG. 3 X |
| 3,853,293 | 12/1974 | Larson | 248/223 |

*Primary Examiner*—Roy D. Frazier
*Assistant Examiner*—Thomas J. Holko
*Attorney, Agent, or Firm*—Olson, Trexler, Wolters, Bushnell & Fosse, Ltd.

[57] ABSTRACT

This invention relates generally to improvements in display rack devices and more particularly to display rack devices adapted for attachment to vertical panels and the like. The present invention as illustrated herein contemplates a plurality of elongate arm members, each having a free extremity for telescopically accommodating goods for display purposes. Mounting means at the opposite extremity of each arm member extend laterally thereof, and an elongate horizontally disposed support member extending substantially normal to said arm members is adapted to accommodate said mounting means in horizontally spaced relation. Means is provided for detachably securing said elongate support member to a vertical panel as for example to a panel commonly known as a pegboard.

9 Claims, 26 Drawing Figures

CUP HOOKS
6 PIECES
BRASS CUP HOOKS

DISPLAY RACK DEVICE

This is a continuation of application Ser. No. 372,411 Filed: June 21, 1973, now abandoned.

SUMMARY OF THE INVENTION

Certain types of merchandise may be marketed to the best advantage by placing such goods in a position so as to be clearly visible to the potential purchaser. It is common practice for example to package articles for sale in transparent plastic containers or bags. Sales appeal may be clearly enhanced by not only displaying such packages attractively but also by mounting said packages on a device of a type which will enable convenient attachment or detachment with respect thereto.

It is, therefore, an important object of the present invention to provide an improved, practical device in the form of a simple yet sturdy rack arrangement for accommodating goods to be displayed.

More specifically, the present invention contemplates a display rack device in which goods for sale may be conveniently displayed in horizontally and vertically spaced relation and to this end it is proposed to provide a novel arrangement of horizontally and vertically spaced arms or hook members upon which goods may be mounted for purposes of display.

A further object of the present invention is to provide a unique display rack arrangement of the type set forth above which is particularly adaptable for use with vertical panels of the type commonly referred to as pegboards.

It is another object of the present invention to provide a display rack device in which a plurality of package accommodating arms may be adjusted laterally to effect the desired horizontally spaced relation thereof.

DESCRIPTION OF THE PREFERRED EMBODIMENTS OF THE INVENTION

Figures 1, 2, 3, 4, 5, 6, 7:
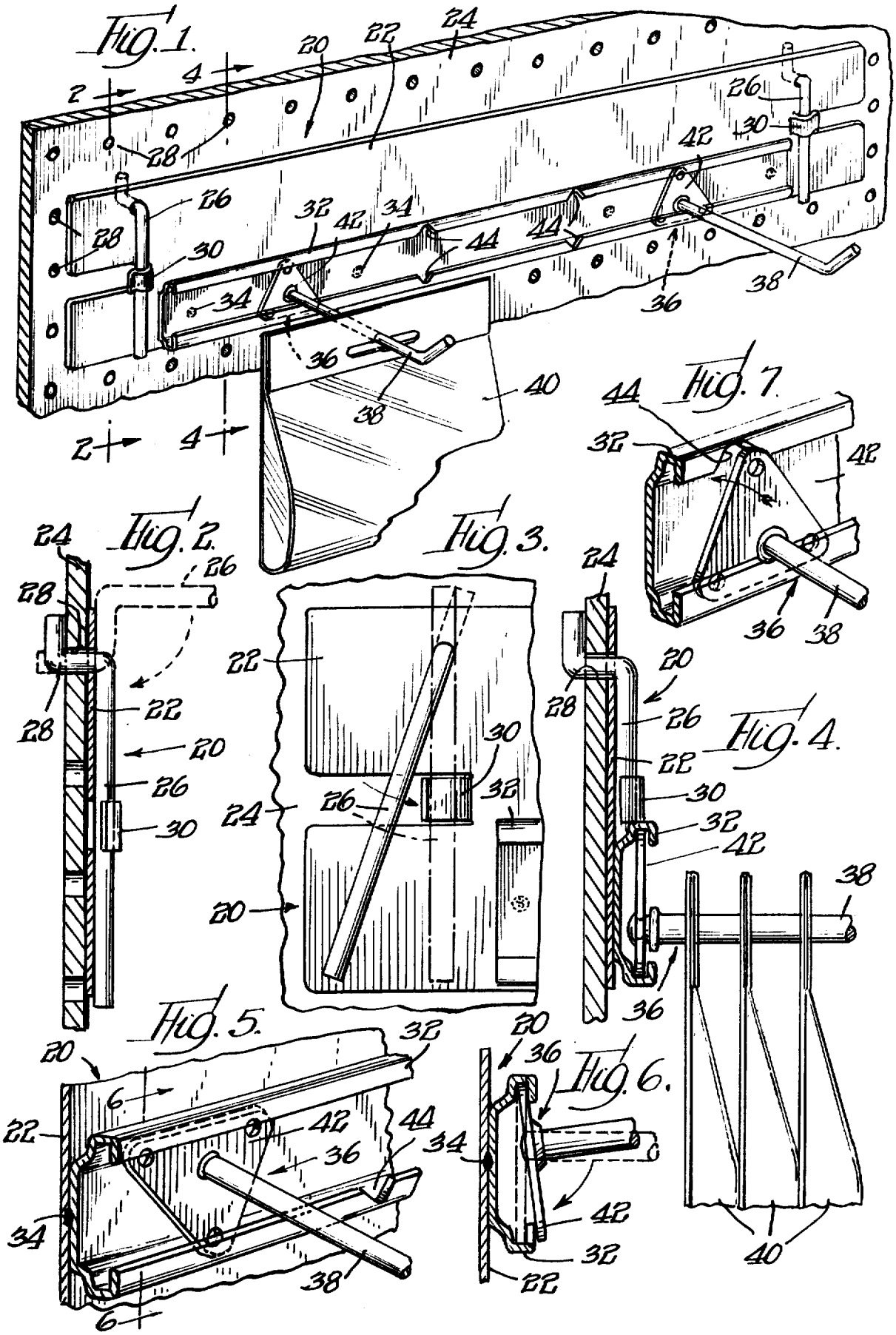
FIG. 1 is a fragmentary perspective view of a pegboard equipped with a display rack arrangement which is representative of one embodiment of the present invention.
FIG. 2 is a fragmentary vertical sectional view taken substantially along the line 2—2 of FIG. 1.
FIG. 3 is a fragmentary elevational view of the left, front side of the display rack shown in FIG. 1, more clearly to illustrate the manner in which the elongate horizontal support member may be detachably mounted with respect to the pegboard.
FIG. 4 is a fragmentary vertical sectional view taken substantially along the line 4—4 of FIG. 1.
FIG. 5 is an enlarged fragmentary perspective view more clearly to illustrate the manner in which a horizontal channel-type member cooperates in the support of an elongate arm adapted to accommodate goods for display purposes.
FIG. 6 is a vertical sectional view taken substantially along the line 6—6 of FIG. 5 illustrating the manner in which one of the arms may be tilted to facilitate attachment to and detachment from the elongate channel member.
FIG. 7 is a fragmentary perspective view showing the mounting extremity of an arm in tilted association with a complementary elongate channel member.

Referring now to the drawings wherein like numerals have been employed to designate similar parts throughout the various views, attention is directed to the display rack device illustrated in FIGS. 1 to 7 inclusive, said device being designated generally by the numeral 20. The display rack device 20 includes a plate member 22 adapted to be mounted upon a conventional vertical panel 24 commonly known as a pegboard.

To facilitate detachable association of the plate 22 with respect to the pegboard 24 is a pair of rod members disposed at opposite extremities of said plate 22. It will be noted that the upper L-shaped extremity of each of the rods 26 is adapted for telescopic association with a complementary aperture 28 of the pegboard 24 as well as a complementary aperture provided within the plate 22. With the rod 26 occupying the position illustrated by dotted lines in FIG. 2, the upper free extremity of the rod may be inserted within the aforesaid apertures and then swung downwardly in the direction indicated by the dotted arrow. With the rods 26 occupying their lowermost position, they may be pivoted in a direction indicated by the arrow in FIG. 3 so as to become resiliently locked by a struck out resilient finger 30. With the depending rods 26 snapped into locking engagement with the fingers 30 as clearly illustrated in FIGS. 1, 2 and 4, the plate 22 is firmly mounted upon the pegboard 24.

An elongate horizontal arm support member 32 of channel-shaped cross section, is secured to the plate in any suitable manner as for example by welds 34. The elongate channel-shaped member 32 is designed to accommodate a plurality of arms or hook devices designated generally by the numeral 36. These arms or hook devices 36 include an elongate arm or hook member 38, the free extremity of which is adapted to telescopically receive articles for display such as the container or bag 40 shown in FIGS. 1 and 4. The opposite extremity of each of the arms 38 is affixed to mounting means or triangularly shaped plates 42. The plates 42 are longitudinally slideable within the elongate support member 32 so as to position the rack arms 38 in desired horizontally spaced relation. The upper and lower flanges of the elongate channel member 32 are provided with recesses 44. It will be apparent from FIGS. 1 and 7 that the apices of the triangular plates 42 project upwardly and that the recesses 44 in the upper flange will accommodate such apices and thereby facilitate attachment to or detachment from the elongate members 32. Likewise, if the apices of the plates 42 project downwardly, as illustrated in FIGS. 5 and 6, the recesses 44 in the lower flange of the elongate member 32 will similarly facilitate reception of the mounting means or plates 42. It is only necessary to tilt the arms 38 after a corner of the plate 42 has been brought into registration with a complementary recess 44.

Figures 8, 9, 10, 11, 12, 13, 14:
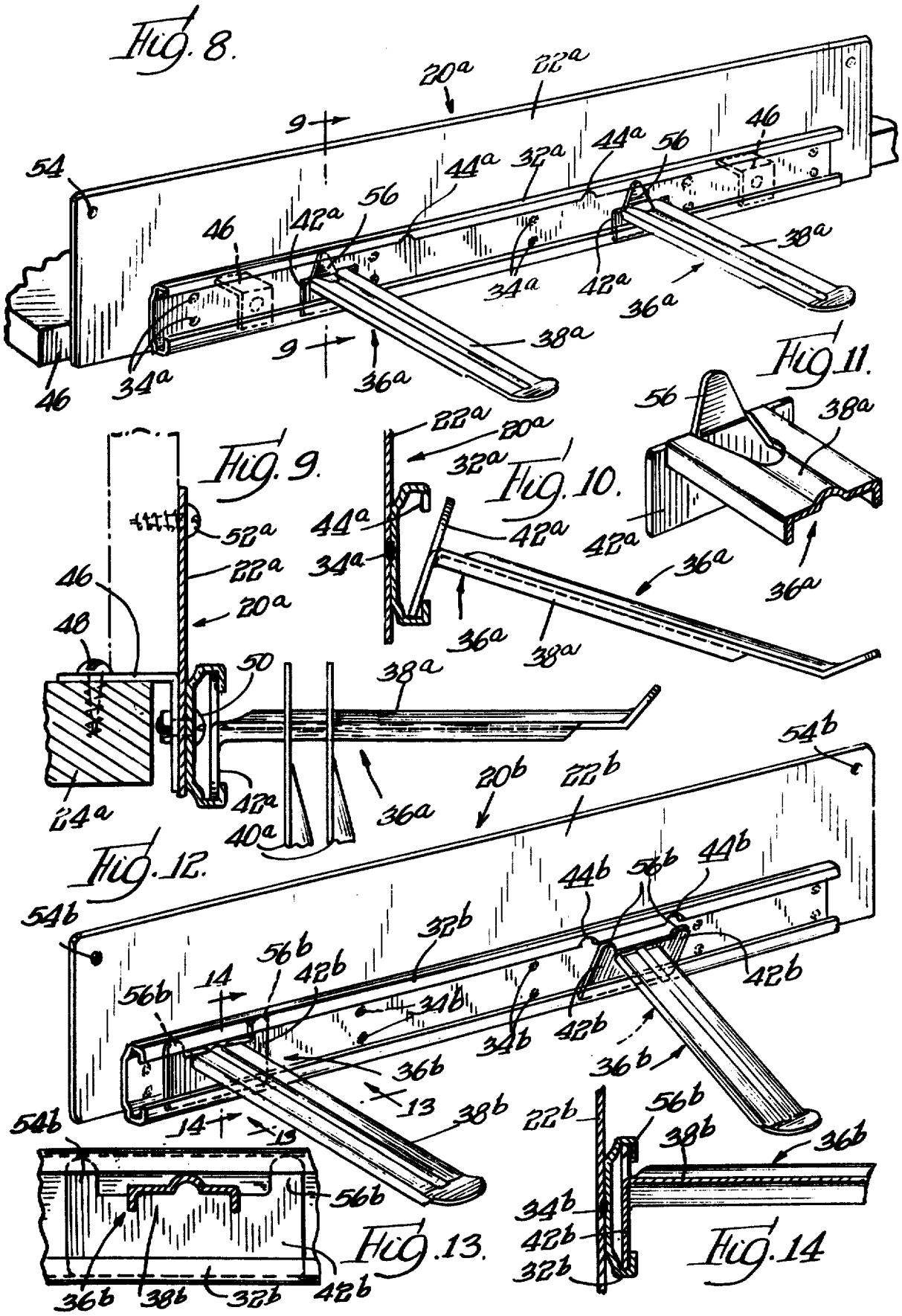
FIG. 8 is a perspective view similar to FIG. 1 illustrating a modified display rack arrangement contemplated by the present invention.
FIG. 9 is a vertical sectional view taken substantially along the line 9—9 of FIG. 8.
FIG. 10 is a view similar to FIG. 6 illustrating the manner in which the display arms or hooks of FIGS. 8 and 9 may be attached to or detached from a horizontal elongate channel member.
FIG. 11 is a detail fragmentary perspective view of the mounting extremity of one of the arms or hooks illustrated in FIGS. 8 to 10 inclusive.
FIG. 12 is another modified display rack arrangement contemplated by the present invention.
FIG. 13 is a horizontal sectional view taken substantially along the line 13—13 of FIG. 12.
FIG. 14 is a fragmentary vertical sectional view taken substantially along the line 14—14 of FIG. 12.

In FIGS. 9 to 11 inclusive, a modified rack device contemplated by the present invention is designated generally by the numeral **20*a*. The rack device 20*a* includes an elongate plate member 22*a* which may be secured to the upper surface of a panel member 24*a* through the agency of a bracket or angle iron 46, FIGS. 8 and 9 by means of a screw member 48 and bolts 50. In instances where the plate member 22*a* is to be secured to the outer surface of a vertically disposed panel indicated by the dot and dash lines in FIG. 9, said plate may be secured in position by screw members 52 insertable within complementary apertures 54**.

The lower portion of the plate **22*a* carries an elongate support member of channel-shaped cross section designated by the numeral 32*a*, said elongate member being suitably secured to the outer surface of the plate 22*a* as by means of welds 34*a*. The elongate channel member 32*a* serves to support a plurality of horizontally spaced hook or arm devices 36*a*. Each of the devices 36*a* includes a sheet metal arm member 38*a* the free extremity of which is adapted to telescopically receive containers in the form of bags 40*a*, FIG. 9. The opposite extremity of each arm member 38*a* is formed with an integral mounting means or plate 42*a* extending normal to the arm member 38*a* which functions similarly to the previously described plate members 42 in interengaging with the elongate support member 32*a*. Each of the plates 42*a* is provided with peripheral tabs 56. These tabs, like the previously mentioned apices of the mounting plate means 42 are adapted for registration with recesses or notches 44*a* provided in the upper flange of the elongate support member 32*a*. When the tab 56 is in registration with a complementary recess 44*a*, the arm 38*a* may be tilted as indicated in FIG. 10 to facilitate detachable association thereof with respect to the elongate channel member 32*a*. The previously described arm members 38 are in the nature of elongate rods, whereas the arm members 38*a*** are in the nature of sheet metal stampings having longitudinal ribs to lend lateral stength thereto.

In FIGS. 12 to 14 inclusive, a still further modified form of display rack device is shown and is designated generally by the numeral **20*b*. The only significant structural difference between the display rack device 20*b* and the previously described rack device 20*a* is in the shape of the plate member 42*b* formed integral with the mounted extremity of an arm of hook member 38*b*. It will be noted that the plate 42*b* is provided with a pair of horizontally spaced tabs or lugs 56*b* which are registerable with recesses 44*b* and correspond functionally with the previously described tabs 56. Other structural details of the device shown in FIGS. 12 to 14** inclusive which correspond structurally and functionally with the previously described elements are designated by like numerals bearing the suffix *b*.

Figures 15, 16, 17, 18, 19, 20, 21, 22, 23:
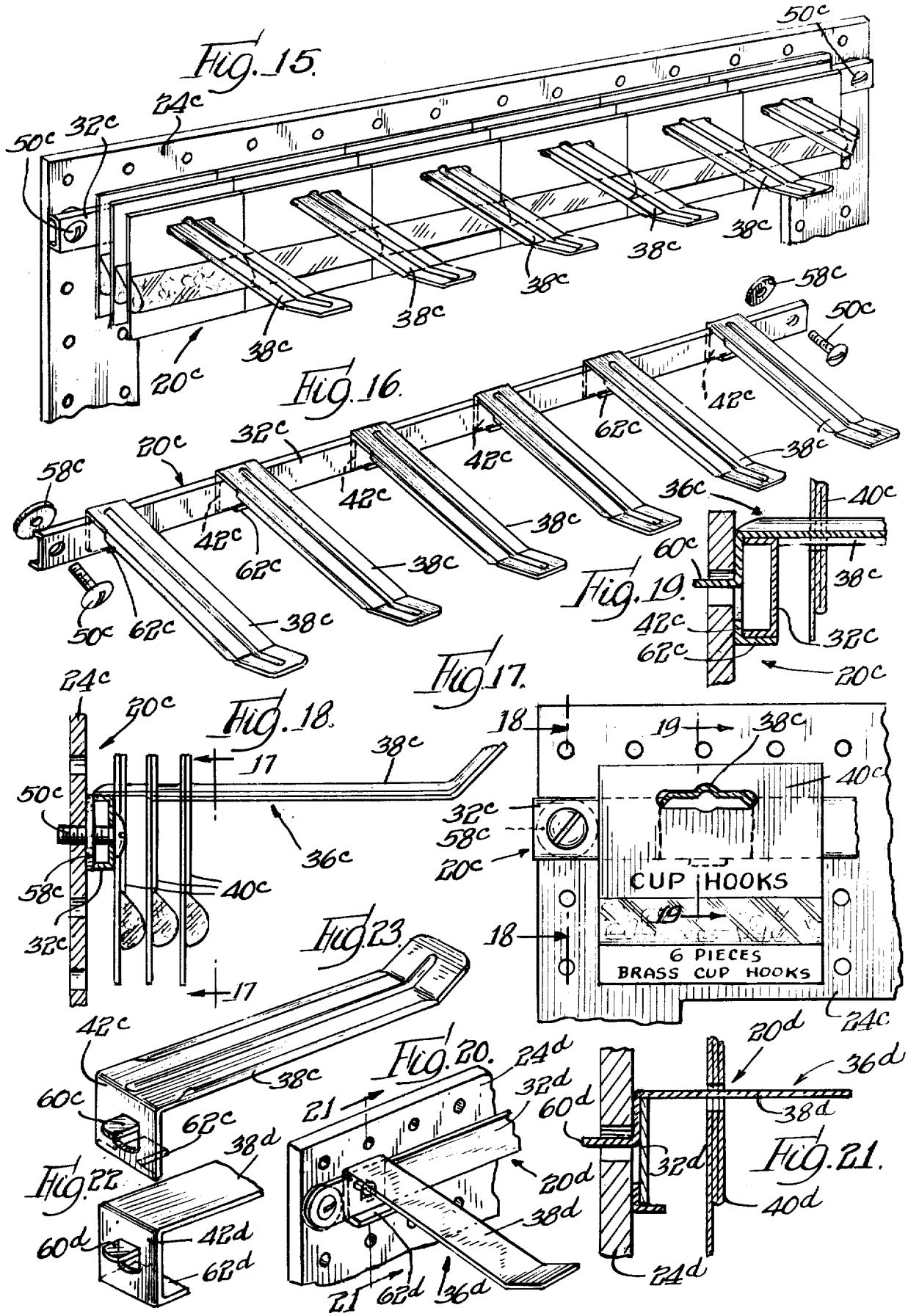
FIG. 15 is a perspective view disclosing a still further modified form of display rack mounted upon a pegboard.
FIG. 16 is a perspective view disclosing the elongate channel member and display hooks of FIG. 15 detached from the pegboard.
FIG. 17 is a fragmentary vertical sectional view taken substantially along the line 17—17 of FIG. 18.
FIG. 18 is a fragmentary vertical sectional view taken substantially along the line 18—18 of FIG. 17.
FIG. 19 is a fragmentary vertical sectional view taken substantially along the line 19—19 of FIG. 17.
FIG. 20 is a fragmentary perspective view of the upper left hand corner as viewed in FIG. 15 of a modified arrangement of a mounting strip and display arm in association with a pegboard.
FIG. 21 is a fragmentary vertial sectional view taken substantially along the line 21—21 of FIG. 20.
FIG. 22 is a fragmentary perspective view of the mounting extremity of the display arm illustrated in FIGS. 20 and 21.
FIG. 23 is a perspective view of a display arm having a mounting extremity differing slightly from the mounting extremity of the arms shown in FIGS. 21 to 22 inclusive.

FIGS. 15 to 19 inclusive and FIG. 23 disclose another modified form of a display rack device contemplated by the present invention, said device being designated generally by the numeral **20*c*. The display rack device 20*c*, like the previously described rack device 20 is particularly adapted to be used in association with a vertical pegboard 24*c*. An elongate channel-shaped arm supporting member 32*c* is secured directly to the pegboard 24*c* by screws 50*c*. The longitudinal edges of the channel member 32*c* are spaced slightly from the outer surface of the board 20*c* in any suitable manner as by means of washers 58*c***.

Particular attention is directed to the structural details of the arm or hook device designated generally by the numeral **36*c*. Arm members 38*c* are structurally and functionally similar to the previously described corresponding members 38*a* and 38*b*. The mounted extremity of each of the arms 38*c* is in the form of an integral plate section 42*c* bent at substantially right angles to the longitudinal axis of the arm. This plate section 42*c* is provided with a struck out tab 60*c* adapted to be telescopically accommodated by a complementary aperture 28*c* of the pegboard 24*c*. A tab or lip 62*c* engages the underside or lower flange of the elongate arm support 32*c*. From the foregoing, it will be apparent that the arms 38*c* are secured in predetermined, horizontally spaced relation upon the elongate support member or bar 32*c*. Containers such as bags 40*c* may be attractively and securely mounted for display purposes upon the arm or hook members 38*c***.

FIGS. 20 to 22 inclusive illustrate another adaptation or modification of the present invention and differs from the structure illustrated in FIGS. 15 to 19 inclusive in the provision of an elongate arm supporting strip **32*d*. In the embodiments of the invention previously described, the elongate arm supporting member is in the form of channel whereas in FIGS. 20 and 21 the elongate arm support member constitutes a flat elongate strip. The display rack device disclosed in FIGS. 20 and 21 is designated generally by the numeral 20*d* and includes a plurality of horizontally spaced arm or hook devices 36*d*. Each of the devices 36*d* include an arm or hook member 38*d* and an integral plate section 42*d* extending normal to its complementary arm member 38*d* as clearly shown in FIG. 22. A tab or shoulder 62*d*** extends from the lower margin of the plate section 42*d* and is adapted to underly the lower edge of the elongate arm supporting member 32*d*. A struck out tab 60*d* functions similarly to the previously mentioned tab 60*c* in securing the arm 38*d* in a predetermined position on a pegboard 24*d*. It will be noted also that the members 36*d* constitute an integral strip of flat stock, the free extremity of which is adapted to telescopically accommodate containers such as bags 40*d*.

Figure 24:
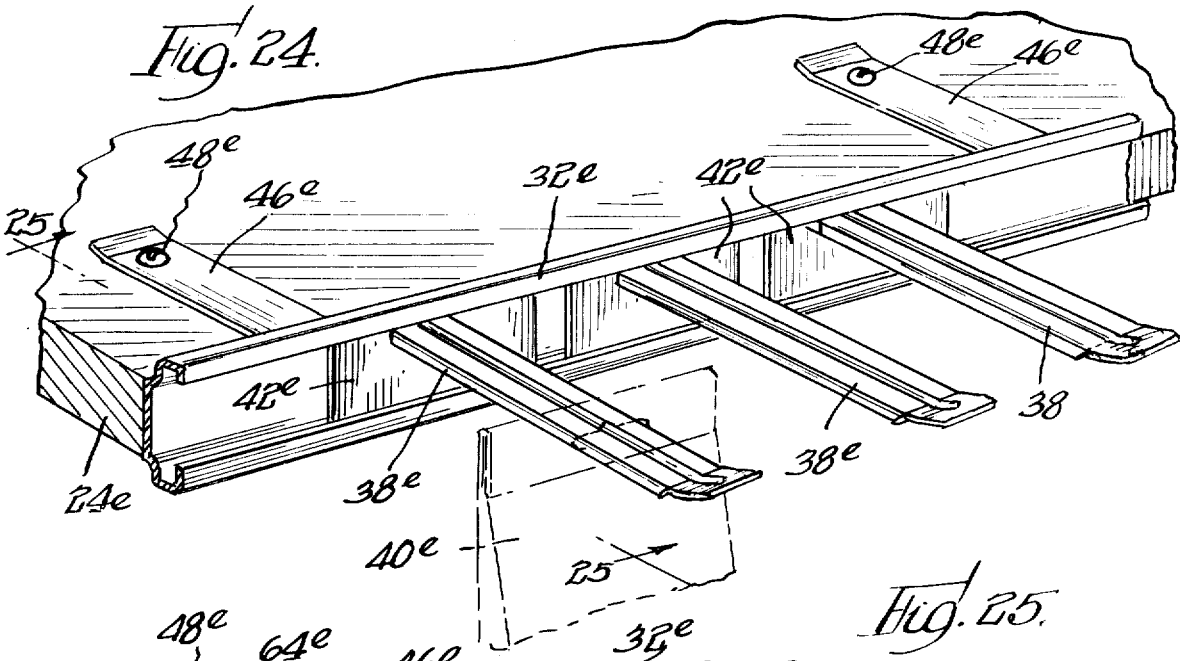
FIG. 24 is a perspective view of another structural adaptation of the present invention.
Figure 25:
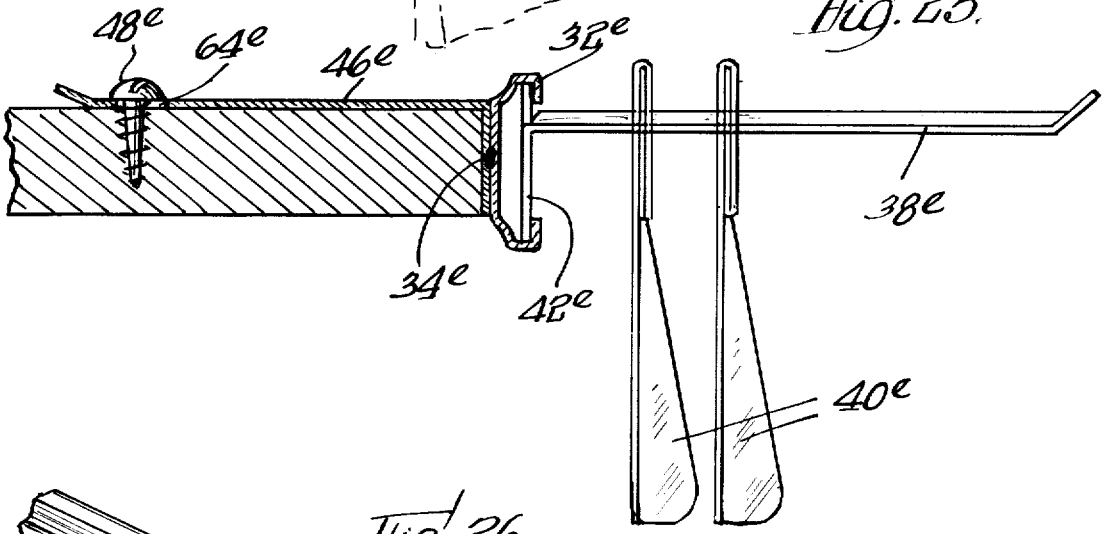
FIG. 25 is a vertical sectional view taken substantially along the line 25—25 of FIG. 24; nd
Figure 26:
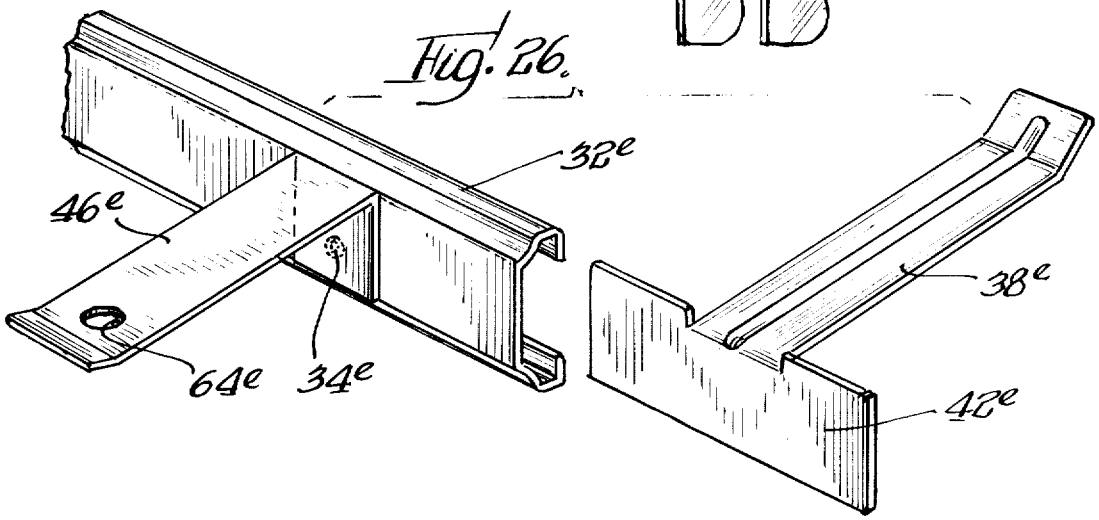
FIG. 26 is a fragmentary sectional view taken from the rear of the elongate channel member and display hook detached therefrom.

In FIGS. 24 to 26 inclusive, a modified arrangement for attaching an elongate channel member 32*e* is disclosed. This arrangement consists of a bracket member 46*e* having a horizontal section for attachment to the upper surface of a shelf member 24*e* and a vertical section welded to the rear surface of the elongate channel member 32*e* to 34*e*. This bracket member 46*e* may be welded to the elongate channel member 32*e* at desired spaced intervals. Each of the horizontal sections of the bracket member 46*e* is provided with an aperture 64*e* for accommodating the head of a screw member 48*e* as shown in FIG. 25. The invention contemplates an arrangement in which the aperture 64*e* is slightly larger than the diameter of the head of the screw member 48*e* so that when the screw member is positioned with the head thereof spaced upwardly from the upper surface of the shelf 24*e*, said aperture will clear the screw head and the bracket shifted slightly forward to interlock with the screw head. To further facilitate attachment of the bracket member 46*e* into interlocking association with the underside of the head of the screw member 48*e*, the free extremity of the horizontal section of the bracket 46*e* may be inclined upwardly as shown in FIGS. 24 to 26 inclusive. Obviously, in instances where it is found desirable, the apertures 64*e* may be smaller than the external diameter of the screw head, thus enabling the screw head to be tightened against the bracket.

It will also be noted that in the modification illustrated in FIGS. 24 to 26 inclusive, hook members 38*e* and their complementary laterally disposed plate members 32*a* may be longitudinally adjusted for positioning within the channel member 32*e*.

From the foregoing, it will be apparent that the present invention contemplates an improved and highly practical display rack device which lends itself for conveniently and attractively supporting goods for display purposes. By having the arm or hook members horizontally spaced in predetermined relation dependent upon the nature of the goods to be displayed, merchandise may be supported in large quantities in a very compact area. Also, the constituent elements of the display rack device herein described are relatively few in number and are adapted to be assembled with the exercise of minimum effort and skill. The present invention contemplates an arrangement of arms or hooks which may be adjustably spaced to accommodate packages or articles of varying widths. Such horizontal spacing adjustment may be accomplished with a minimum of effort and skill.

While for purposes of illustration, certain structural details envisioned by the present invention have been disclosed herein. It should be understood that said invention is limited only by the scope of the appended claims.

The invention is claimed as follows:

1. A display rack device for attachment to an apertured vertical panel, said device including a plurality of generally elongate arms each having a free extremity for telescopically accommodating goods for display purposes, mounting means associated with the opposite extremity of said arms and extending laterally thereof, an elongate horizontal support member extending substantially normal to said arms for accommodating a plurality of said mounting means in horizontally spaced relation, a plate to which the elongate support member is secured along the length thereof for attaching said elongate member to an apertured vertical panel and with the ends of the support member terminating short of the ends of the plate leaving plate end portions beyond each end of the support member, said plate having at least two longitudinally spaced apertures, one through each of said plate end portions and offset outwardly of adjacent ends of the support member to be placed in registry with two apertures of said apertured vertial panel, and rod means having a first bent portion for insertion through the aligned apertures of said plate and said apertured vertical panel and moved into position behind said apertured vertical panel, and a forwardly offset second bent portion to be placed over the front face of said plate end portions, and a resilient gripping finger formed as an integral part of each said plate end portion and extending forwardly from the front face thereof and presenting an open throat between the ends of the support member and the plate to receive the second bent portion of said rod means transversely across the plate end portions and spaced from adjacent ends of the support member for resiliently and removably securing it in place in direct surface contact against the front face of the plate end portions, thereby securing said plate and said support member to said apertured vertical panel.

2. A display rack device for attachment to a vertical panel as set forth in claim 1, wherein the mounting means associated with an extremity of each arm is longitudinally adjustable upon said elongate horizontal support member.

3. A display rack device for attachment to a vertical panel as set forth in claim 1, wherein the mounting means associated with the extremity of said arms is longitudinally slidable within said elongate horizontal support member.

4. A display rack device for attachment to a vertical panel as set forth in claim 1, wherein the elongate horizontal support member is channel-shaped in transverse cross section.

5. A display rack device for attachment to a vertical panel as set forth in claim 4 wherein said channel-shaped elongae support member is recessed at horizontally spaced intervals to facilitate detachable association therewith of said mounting means.

6. A display rack device for attachment to a vertical panel as set forth in claim 5, wherein said mounting means is peripherlly shaped to be accommodated by said recesses.

7. A display rack device for attachment to a vertical panel as set forth in claim 5, wherein said mounting means is provided with tabs shaped to be accommodated by said recesses.

8. A display rack device for attachment to a vertical panel as set forth in claim 1, wherein said mounting means is in the form of a plate extending transversely with respect to the longitudinal axis of a complementary arm.

9. A display rack device for attachment to a vertical panel as set forth in claim 1 wherein the gripping finger is struck from the material of the plate end portions to present a laterally open reduced throat in endwise spaced adjacency to the end of the support member for snap engagement with the rod means.

* * * * *